US010850207B2

(12) United States Patent
Tilley

(10) Patent No.: US 10,850,207 B2
(45) Date of Patent: Dec. 1, 2020

(54) STRING LAUNCHED FLEXIBLE ROLLING WHEEL

(71) Applicant: Martin Clay Tilley, Twin Falls, ID (US)

(72) Inventor: Martin Clay Tilley, Twin Falls, ID (US)

( * ) Notice: Subject to any disclaimer, the term of this patent is extended or adjusted under 35 U.S.C. 154(b) by 0 days.

(21) Appl. No.: 16/576,754

(22) Filed: Sep. 19, 2019

(65) Prior Publication Data

US 2020/0088490 A1 Mar. 19, 2020

Related U.S. Application Data

(60) Provisional application No. 62/733,619, filed on Sep. 19, 2018.

(51) Int. Cl.

| | |
|---|---|
| ***A63H 33/18*** | (2006.01) |
| ***A63B 65/00*** | (2006.01) |
| ***A63H 33/02*** | (2006.01) |
| ***F41B 3/04*** | (2006.01) |
| ***A63B 59/30*** | (2015.01) |

(52) U.S. Cl.

CPC ..... *A63H 33/02* (2013.01); *A63B 59/30* (2015.10); *A63H 33/18* (2013.01); *F41B 3/04* (2013.01)

(58) Field of Classification Search

CPC ..... A63H 17/008; A63H 33/02; A63H 33/18; A63B 59/30; A63B 65/122

USPC ..... 446/46, 48, 431, 450; 473/569, 588, 589

See application file for complete search history.

(56) References Cited

U.S. PATENT DOCUMENTS

| | | | | | |
|---|---|---|---|---|---|
| 281,773 | A | * | 7/1883 | Mann | A63B 65/08 473/589 |
| 2,232,244 | A | * | 2/1941 | Kiefer | A63H 33/02 446/269 |
| 2,463,670 | A | | 8/1946 | Yankelevtz | |
| 2,613,476 | A | * | 10/1952 | Metz | A63H 33/02 446/452 |
| 2,624,157 | A | * | 1/1953 | Weeks | A63H 33/02 446/452 |
| 2,624,977 | A | * | 1/1953 | Baker | A63H 1/00 446/429 |
| 2,797,100 | A | * | 6/1957 | Raffaelli | A63H 33/18 273/129 R |
| 3,528,194 | A | * | 9/1970 | Motluk | A63H 33/02 446/247 |
| 3,566,532 | A | * | 3/1971 | Wilson | A63H 33/18 446/46 |
| 3,590,518 | A | * | 7/1971 | LeBaron | A63H 33/18 446/64 |

(Continued)

*Primary Examiner* — Alexander R Niconovich
(74) *Attorney, Agent, or Firm* — Jack M. Choules

(57) ABSTRACT

The string launched flexible rolling wheel or "Sling Wheel" is used for recreational play. The Sling Wheel is a flexible, 5 to 10-inch diameter disc/wheel that has a deep slot in which to wind a length of string with a knot or a device with which to grip or otherwise attach to the finger(s) or hand. The end of the string without the knot or handle is wound in the slot a number of turns. After the string is wound, the Sling Wheel is tossed in an underhand or overhand motion while keeping the string knot firmly grasped. The Sling Wheel spins away from the participant with a forward spin that gives it directional control and significant velocity. The string remains with the person launching the toy.

7 Claims, 2 Drawing Sheets

(56) References Cited

U.S. PATENT DOCUMENTS 3,823,507 A * 7/1974 Berner ..... A63H 33/02 446/450
3,935,663 A * 2/1976 Leibowitz ..... A63H 27/12 446/48
4,075,781 A * 2/1978 Hill, II ..... A63H 33/18 446/48
4,337,593 A * 7/1982 McAllister ..... A63B 67/08 446/236
4,370,824 A * 2/1983 Resnicow ..... A63H 33/18 244/12.2
4,501,568 A * 2/1985 Nagaoka ..... A63B 21/0624 446/450
4,531,923 A * 7/1985 Lohr ..... A63H 33/26 273/109
4,687,210 A * 8/1987 Michel ..... A63B 43/002 473/569
4,752,267 A * 6/1988 Layman ..... A63H 33/18 446/46
4,854,907 A * 8/1989 Holmes ..... A63H 33/18 446/48
4,915,661 A * 4/1990 Getgey ..... A63H 33/18 446/48
4,955,842 A * 9/1990 Marcotti ..... A63H 33/18 446/46
5,020,808 A * 6/1991 Richards ..... A63H 33/18 446/48
5,066,258 A * 11/1991 Tomberlin ..... A63H 1/30 446/40
5,080,624 A * 1/1992 Brinker ..... A63H 27/12 446/266
5,116,275 A * 5/1992 Sassak ..... A63H 3/003 220/732
5,195,916 A * 3/1993 Her ..... A63H 33/18 446/255
5,562,512 A * 10/1996 Samelian ..... B63C 9/26 441/81
5,895,299 A * 4/1999 Hyde ..... B63C 9/26 242/405
5,951,353 A * 9/1999 Moore ..... A63H 33/18 446/247
6,347,973 B1 * 2/2002 Grant, III ..... A63H 33/02 446/450
6,585,552 B2 * 7/2003 Huset ..... A63H 33/18 446/253
6,595,823 B2 * 7/2003 Huset ..... A63H 33/18 446/253
6,629,867 B1 * 10/2003 Smith ..... B63C 9/22 441/81
7,621,796 B2 11/2009 Schonert et al.
7,878,929 B2 * 2/2011 Perry-Smith ..... A63H 27/14 473/505
8,246,497 B1 * 8/2012 Garcia ..... A63B 65/10 473/613
9,174,712 B2 * 11/2015 Klotz ..... B63C 9/082
9,707,488 B2 * 7/2017 Lennon ..... A63H 17/008
9,821,245 B2 * 11/2017 Larsen ..... A63H 33/088
2006/0211331 A1 * 9/2006 Trageser ..... A63H 33/007 446/429
2016/0101372 A1 * 4/2016 Antolin ..... A63H 33/26 446/132

* cited by examiner

STRING LAUNCHED FLEXIBLE ROLLING WHEEL

BACKGROUND

The preferred embodiment of the invention is a toy disk or wheel used for recreational proposes. For the purpose of this disclosure a disk is considered to be an object in the general shape of a wheel, not a solid disk as it has at least a slot in it, but a disk capable of rolling along its circular edge or the surface of its circumference. The wheel is launched by hand, using a cord or string. And can be used in various games. For example, a course can be set up similar to a Frisbee golf course where the wheels are launched towards one or more targets. The cord is wound into a slot in the wheel. Friction between the slot and the cord causes the wheel to spin rapidly as it comes off the string. The rapid rotation propelling the wheel forward at a faster speed and with more control than simply tossing the wheel.

Prior devices have included systems for launching a disk or wheel toy. U.S. Pat. No. 2,624,977 is directed to a disk that is spun to a high speed by wrapping a string around a hub and pulling it, so the string spins the hub and the disk. The disk is held in place by an axle and/or handle until released. There is no slot or friction with the slot. The current invention eliminates the need for axles or handles to hold the disk while spinning up. US patent application US 2006/0211331 A1 details a wheel that is spun as the teeth on a strap pull the teeth on a gear connected to its hub again while connected to a handle to be held while the wheel is being spun. Also, there is no slot or friction between a cord and a slot for causing the wheel to spin.

A spinning disk that does have a slot and string is a Yo-yo U.S. Pat. No. 2,463,670 shows a Yo-yo that spins as the sting is pulled out of the slot and unwinds from a post in the center of the slot however the string is fixed to the post and does not release. The string is fixed to the Yo-yo and cord caused the Yo-yo to spin by the unwinding of the winding against the tension from this fixed end of the string. In the preferred embodiment of current invention, the string is only held in place by friction between the string and the slot so when the string unwinds the wheel comes free of the string. Also, an embodiment of the invention has a system of flexible, angled spokes for suspension which were not found in these 3 examples.

SUMMARY OF AN EMBODIMENT OF THE INVENTION

The Sling-wheel is a wheel or disk intended to be used for recreational games. The disk has an outer band that is round and is placed at the outer circumference of the disk. The band being the part of the disk that rolls on the ground as the disk/wheel travels. This band is divided in half to form matching bands by a slot formed into the outer circumference of the slot with its depth toward the center of the disk. Each band forms a parallel full circle at the outer circumference. The slot has a depth that provides between 30 and 60 percent of the disk's radius. A string or cord is placed in the slot by wrapping it around the circumference of the base of the slot between the walls of the slot. The cord is held in place by friction with the slot. Friction between the disk slot and cord causes the disk to rotate when the cord is pulled out of the slot. The walls of the slot are made from a flexible material and preferably have angled spokes that provide a suspension for the disk to absorb force from bumps or collisions. When the cord is wrapped in the slot the participant who wishes to launch it attaches the outer end of the cord to his hand by looping it around a couple of his fingers. The participant then throws the wheel so it will land upright to roll while retaining the end of the cord, so the cord is pulled from the disk wheel causing the wheel to spin somewhat faster that its ground speed. The forces caused by the rapidly spinning wheel stabilize the wheel and possibly cause it to accelerate when it lands on the ground.

DETAILED DESCRIPTION

Figure 1:
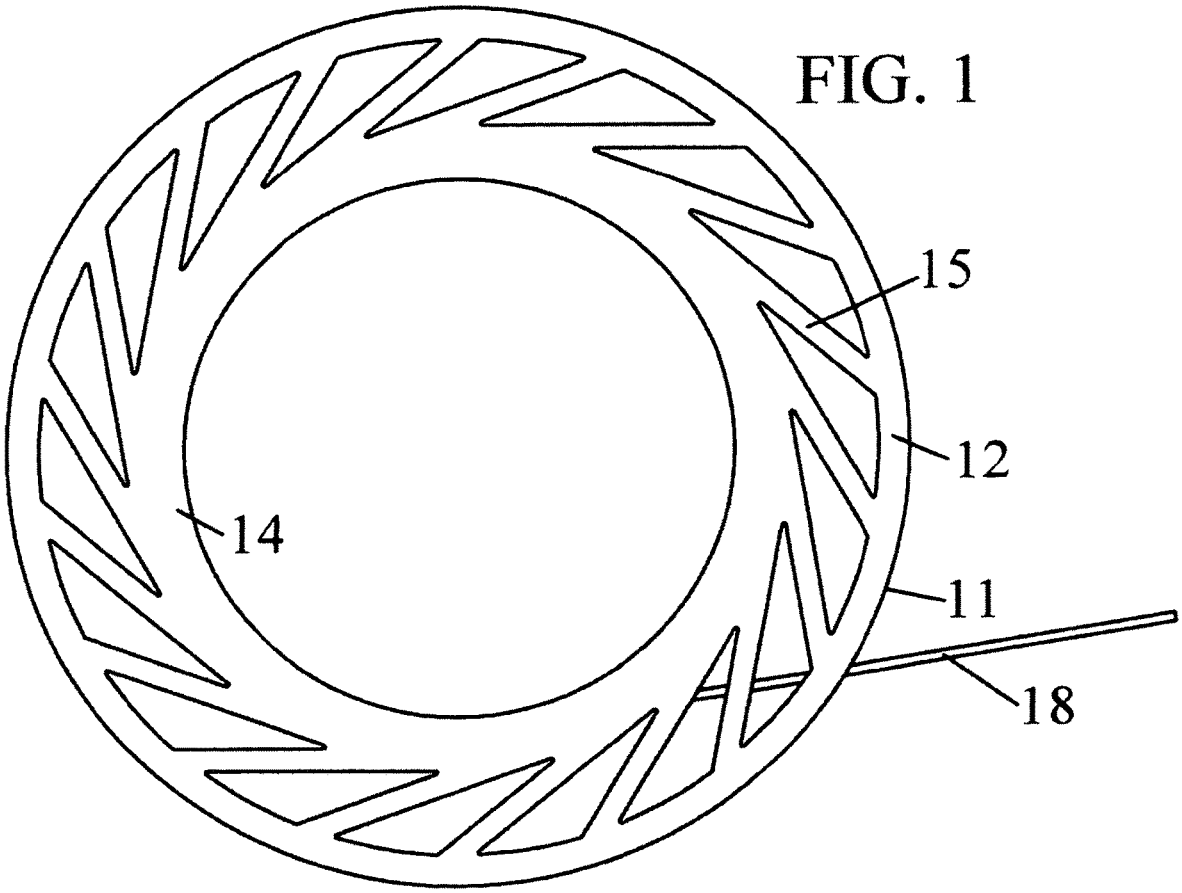
FIG. 1 is a side view of the preferred embodiment of the invention including the wheel and the cord.
Figure 2:
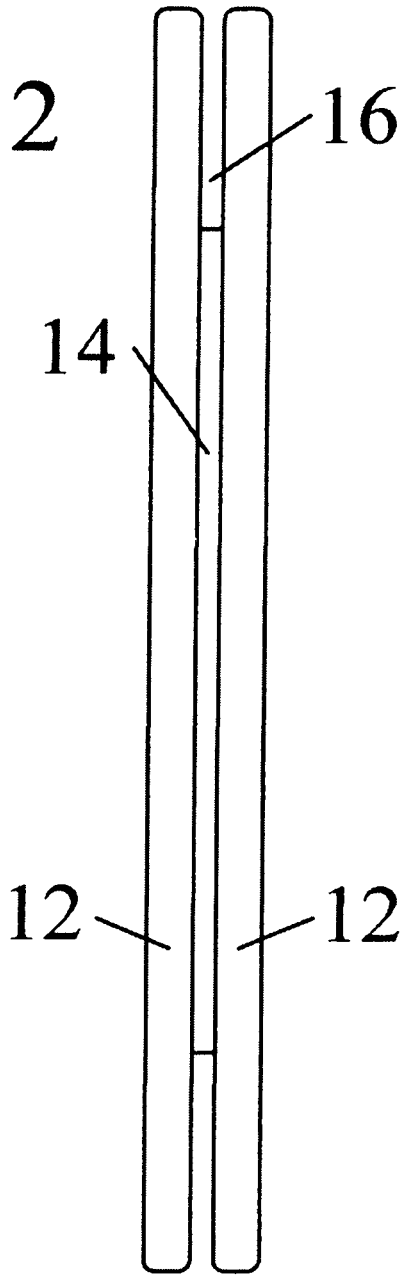
FIG. 2 is the profile or edge view of the wheel shown in FIG. 1.

FIGS. 1 and 2 show different views of the Sling Wheel, which includes a disk (11) made from a durable flexible material. The durable flexible material may a plastic, polypropylene, or any other flexible material that can maintain its approximate shape while in storage and in play. The disk (11) may be molded in one piece or in multiple pieces assembled from different materials optimized for different parts. The disk (11) has outer bands (12) that are round and are placed at the outer circumference of the disk. The band being the part of the disk that rolls on the ground as the disk/wheel travels. The bands are divided in half by a slot (16) formed into the outer circumference of the disk (11), to form matching bands (12). Each band (12) forms a parallel full circle at the outer circumference.

The flexible material of the Sling-wheel in combination with angled spokes (15) provides a built-in suspension to facilitate less bounce when the wheel encounters rough terrain. The suspension also reduces the chances it will cause pain, injury or damage should it come in contact with persons, objects or animals. One of skill in the art would realize that there are other design choices that could also provide the flexibility for a suspension such as solid but thinner flexible walls or fewer or more flexible spokes aligned more closely with the radius of the disk.

The string winding slot (16) has a width and depth designed so that the string unwinds with the proper amount of friction and with the right ratio, of the radius of the disk to radius of the cord forms in its position in the slot, to create a forward spin on the toy. If the friction coefficient between the slot and string is low the string and slot width may be chosen so that the string is as wide as or slightly wider than the slot to increase the friction as needed to get a good spin. If the friction coefficient is sufficient on its own this is not necessary. The inner ring (14) is a solid ring the full width of the disk forming the bottom of the slot. The 4-6 feet of string (18) is properly sized so that it fits snugly as it is wound into the string slot (16) in the middle of the Sling-wheel. This creates just enough friction so that the string can put a forward spin on the Sling-wheel. The participant throws the Sling-wheel either overhand or underhand while retaining the rope end wrapped in his or her fingers. The force of the throw combined with the retention of the string cause the string to unwind from the slot putting the forward spin on the Sling-wheel. This spinning action creates forces that help the Sling Wheel maintain a desired trajectory, and greatly increases its launching speed. The properly sized string (18) is an important part of the invention. The increased spin provided by the string allows the Sling-wheel to be launched with far greater speed and accuracy than can be achieved by merely throwing the Sling-wheel by hand.

Many games can be envisioned that use the Sling-wheel. One game that is popular starts with a selected member of the group setting up a two- or three-point course marked by trees, decorative rock or other features that typically exist in a park or campus setting. The person completing the course with the least number of launches wins and gets to call out the next course.

For general play a wheel size of between 5 and 10 inches in diameter gives good results being large enough to roll across most terrain suitable for play, but not so large as to be unwieldy when launching. A slot depth of between 30 to 60 percent of the radius will give the Sling-wheel the proper rate of spin so that its surface speed matches or exceeds its ground speed when it comes in contact with the playing surface after the launch.

The embodiment of the invention that is set forth in the description and the illustrations is to be considered illustrative in nature and not restrictive. The embodiment shown and described in this specification are for satisfaction of the best mode and enablement requirements. One of ordinary skill in the art could make numerous adaptations and changes some are discussed herein others may also be obvious. It would be impractical to attempt to describe all such variations to the embodiment in the present specification. Thus, it is to be understood that protection is sought for all changes that come within the spirit of the invention as set forth by the claims.

I claim:

1. A recreational disk with a cord used for launching the disk comprising:

two round outer bands on an outer edge of the disk that each form a full circumference of the disk;

a round inner ring to the disk, supporting structures that connect the inner ring to each one of the two outer bands the two outer bands, the supporting structures and the ring being configured to form a slot in the said disk between the two outer bands and the supporting structures for each band;

the slot receiving the cord;

the cord is wound around a circumference of the ring and the cord is held in the slot by friction and comes free of the disk when the disk is launched.

2. The recreational disk of claim 1 where a diameter of the cord is equal to or wider than a width of the slot resulting in friction between the cord and the disk, the friction causing the disk to spin as the cord unwinds during the launch of the disk.

3. The recreational disk of claim 1, where the supporting structures includes flexible material as a suspension.

4. The recreational disk of claim 3, where the suspension includes flexible spokes.

5. The recreational disk of claim 3, where the recreational disk is made from a flexible material.

6. The recreational disk of claim 1, where the slot has a depth which is 30 to 60 percent of the disks total radius.

7. A string launched toy wheel for recreational play, the string launched toy wheel comprising:

a string holding means to receive the string and provide rotational motion to the wheel as the string is removed from the toy wheel during launch;

a shock absorption means to absorbs force from bumps and collisions; and a rolling means to use force from the launch and the rotational motion to roll across a surface.

* * * * *